United States Patent [19]

Ikeda

[11] Patent Number: 4,775,176

[45] Date of Patent: Oct. 4, 1988

[54] AUTOMOBILE DOOR LATCH

[75] Inventor: Ichio Ikeda, Aichi, Japan

[73] Assignee: Kabushikikaisha Anseikogyo, Aichi, Japan

[21] Appl. No.: 28,988

[22] Filed: Mar. 23, 1987

[30] Foreign Application Priority Data

Sep. 22, 1986 [JP] Japan ..... 61-224642

[51] Int. Cl.[4] ..... E05C 3/26

[52] U.S. Cl. ..... 292/216; 292/DIG. 38; 292/337

[58] Field of Search ..... 292/48, 216, 280, DIG. 38, 292/337

[56] References Cited

U.S. PATENT DOCUMENTS

| | | | |
|---|---|---|---|
| 3,432,198 | 3/1969 | Connor | 292/216 |
| 3,614,146 | 10/1971 | Marx | 292/216 |
| 3,876,238 | 4/1975 | Watermann | 292/216 |

*Primary Examiner*—Richard E. Moore

*Attorney, Agent, or Firm*—Pollock, Vande Sande & Priddy

[57] ABSTRACT

A latch body is formed, at its recessed inner side, with a pair of integral tubular members made of plastics. A latch element adapted to catch a striker set in an automobile door and a paul are rotatably mounted on the tubular members for engagement with each other. A latch returning spring is stretched between the body and the latch element. An door opening lever and a door locking lever both linked to the pawl are rotatably mounted on another pair of plastic tubular members each of which is formed on the outer side of said body in the coaxial relation with corresponding one of the first pair of the tubular members. Each of a pair of pins is inserted through the tubular members in the coaxial relation and is swaged in a base plate coupled oppositely with the body.

8 Claims, 6 Drawing Sheets

AUTOMOBILE DOOR LATCH

BACKGROUND OF THE INVENTION

1. Field of the Invention

This invention relates generally to a latch for use on the door of an automobile and, more particularly, to a latch in which a latch element and a pawl are mounted for respective turning movement on a pair of pins secured in a base plate by swaging and are relatively positioned for engagement.

2. Description of the Prior Art

In a known latch for an automobile door, such as disclosed in the specification of U.S. Pat. No. 3,614,146, a pair of pins are set upright, at their one ends, in a base plate by swaging. A latch element is rotatably mounted on one of the pins and a pawl similarly on the other pin. A latch returning spring is connected to the latch element. The whole structure of the latch is then completed by attaching another separate base plate to the other ends of the pins by swaging.

In the structure of this type, both ends of either pin must be swaged to the respective separate base plate. Namely each pin has to be caulked at two portions, at its both ends, and it has been expected to reduce the number of swaging procedures.

In the factory where the inventor works, the following process is adopted. A base plate provided with at least two holes for swaging, a hollow recessed body member provided with at least two holes, a pair of pins each having a swaging stepped portion at its one end and a head portion with an enlarged diameter at its other end, a latch element, a latch returning spring and a pawl are prepared. When these component parts are assembled to an automobile door latch, the two pins, except their head portions, are first inserted through the two holes bored in the body. Then the latch element is mounted on one of the pins and the pawl on the other pin. A positional relationship is established in which the latch element and the pawl are engageable with each other and both rotatable. Further, the work to put the body on the base plate and the work to insert the free ends of both pins into the holes for swaging in the base plate are simultaneously carried out. The free ends of the pins are then secured in the base plate by swaging and the body is thus united with the base plate. In this manner, the base plate and the body form a casing enclosing the latch element and the pawl. This latch assembling process has the advantage that only one swaging work suffices for each pin by assembling the separately prepared component parts, the body, the latch element, the pawl, pins and the base plate, in the above mentioned manner.

When the free ends of the both pins are inserted into the holes in the base plate, the latch returning spring is, however, already attached to the latch element in advance. The spring exerts a force on the latch element in the direction perpendicular to the turning axis of the latch element. On account of this force, the latch element inclines one of the pins. It is difficult to insert the free ends of one inclined pin and the other upright one into the two holes in the base plate. It is impracticable and troublesome to put simultaneously the body over the base plate and to insert the pins into the holes.

On the other hand, the pins, and the latch element and pawl mounted both rotatably on them are, in general, made of metallic materials. Consequently an undesirable noisy metallic sound is uttered due to the direct contact and collision between metallic component parts every time the latch element is operated.

SUMMARY OF THE INVENTION

It is, therefore, a first object of the present invention to provide an automobile door latch which can simply be assembled without requiring much time.

A second object of the present invention is to provide a latch body for an automobile door latch to which a latch element and a pawl can be attached before the overall assembly of the latch so that the appropriate positional relationship for proper operation between the latch element and the pawl may be obtained.

A further object of the present invention is to provide a latch body with use of which any metallic sound between the latch element and its pin or between the pawl and its pin when the latch element is operated is suppressed.

A still further object of the present invention is to provide a latch body which can form a casing to contain a latch element and a pawl for smooth operation when the body is united with the base plate.

A still further object of the present invention is to provide a latch body provided with means which can prevent a latch element and a pawl both attached to the body from slipping off accidentally.

A still further object of the present invention is to provide a latch body provided with a tubular member made of plastics which is used to bear beforehand a latch element in the assembling procedure of a latch and is reinforced interiorly by an inserted pin to be neither bent nor broken after the body is united with a base plate.

According to the basic features of the present invention two tubular members made of plastics are formed integrally with a latch body made similarly of plastics provided with a latch element space and a pawl space. Before the overall assembling of a latch, the latch element and the pawl are mounted on the outer peripheral surface of the tubular member so that the appropriate engaging operation of them may be possible. A returning spring is interposed between the latch element and the body and exerts a force on the latch element to turn it in one definite direction. The latch returning spring connected to the latch element exerts a biasing force, in this manner, on the latch element in the direction perpendicular to the turning axis of the latch element. The axis of the latch element, however, is not deflected since the latch element is mounted on the tubular member. Accordingly, only if some positioning members formed on the body are coupled with the base plate, the center of a hole in the base plate, the axis of the tubular member on the body and the axis of the latch element coincide with one another. With all the center and the axes coinciding, the free ends of the pins can be inserted through the tubular members into the holes bored in the base plate.

Furthermore, the plastic tubular members can be reinforced interiorly by the inserted pins. The tubular member can resist the strong impact applied to the latch element without being bent or broken. This tubular member interposing between the latch element and its pin prevents the direct contact of them and therefore the occurrence of the metallic sound uttered by the contact.

BRIEF DESCRIPTION OF THE DRAWINGS

FIG. 15 being a section for explaining the procedure to attach the locking lever and the opening lever to the latch body, FIG. 16 being a section for explaining the procedure to swage the pins to the latch body and FIG. 17 being a section taken along line XVII—XVII in FIG. 14.

DETAIL DESCRIPTION OF THE PREFERRED EMBODIMENTS

Figure 1:
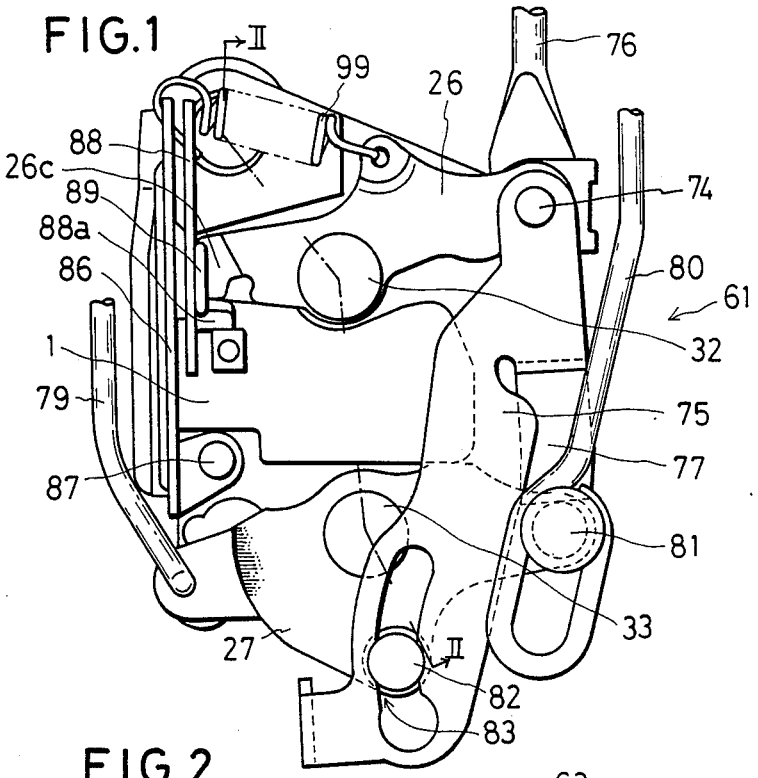
FIG. 1 is a front elevation of an automobile door latch.

In FIGS. 1 through 4, an automobile door locking apparatus comprises a striker 9 set in the body of an automobile and an automobile door latch 61 set in the door panel 60 of the automobile door. The door latch 61 includes a base plate 62, pins 32, 33 secured firmly on the plate 29 at one ends thereof, a latch element 22 mounted rotatably on the pin 32, a pawl 24 mounted rotatably on the pin 33, a latch body 1 coupled oppositely with the base plate 29 and various elements attached to the body 1.

The body 1 is made of plastics and is formed with a recessed portion 2. The recessed portion 2 provides a latch space 3 and a pawl space 4 (see FIG. 5). Positioning elements 97, 98 are formed on the bottom wall of the body 1 at two positions confronting the spaces 3, 4 respectively. These positioning elements are adapted to restrict the axial displacement towards the body 1 of the latch element 22 and the pawl 24. A numeral 5 represents a side wall closing the side portion of the recessed portion 2. The upper edge of the side wall 5 is formed with an abutting surface 6 to receive the edge of the inner surface of the plate 29 and a positioning surface 7 to prevent the transverse movement of the plate 29 relative to the body 1. These surfaces 6, 7 serve as members to position the plate 29 relative the body 1. A numeral 8 represents a groove through which the striker 9 comes in and goes out. A pin insertion mount 10 formed on the bottom wall of the body 1 at a corresponding position in the latch space 3 and formed interiorly with an axial hole 11 for insertion of the pin 32. Another pin insertion mount 12 is formed on the bottom wall of the body 1 at a corresponding position in the pawl space 4 and is formed similarly with another axial hole 13. A tubular member 14 is formed integrally with one end portion of the pin insertion mount 10 and is coaxial with the axial hole 11. The inner diameter of this tubular member 14 corresponds to the diameter of the pin 32 and the outer diameter of the member 14 corresponds to the diameter of a mounting hole **22*a* of the latch element 22. A numeral 15 formed on the extreme end portion of the tubular member 14 represents a contact surface to receive the plate 29. The height from the end surface of the pin insertion mount 10 to the contact surface 15 is adjusted to such a value that the latch element 22 is not caught fixedly between the plate 29 and the body 1 when they are coupled oppositely with the latch element 22 sandwiched therebetween. Namely the height is determined in such a manner that the gap formed in the latch space 3 between the coupled plate 29 and body 1 is slightly larger than the thickness of the latch element 22. Another tubular member 16 is formed integrally with the other end of the pin insertion mount 10 and is coaxial as well with the axial hole 11. The other diameter of this tubular member 16 corresponds to the diameter of a mounting hole of an opening lever to be described hereinafter. A tubular member 17 is formed integrally with one end portion of the pin insertion mount 12 and is coaxial with the axial hole 13. The inner diameter of this tubular member 17 corresponds to the diameter of the pin 33 and the outer diameter of the member 17 corresponds to the diameter of a mounting hole 24*a* of the pawl 24. A numeral 18 represents a contact surface to receive the plate 29. The height from the end surface of the pin insertion mount 12 to the contact surface 18 is adjusted to such a value that the pawl 24 is not caught fixedly between the plate 29 and the body 1 when they are coupled oppositely with the pawl 24 sandwiched therebetween. Namely the height is determined in such a manner that the gap formed in the pawl space 4 between the combined plate 29 and body 1 is slightly larger than the thickness of the pawl 24. Another tubular member 19 is formed integrally with the other end of the pin insertion mount 12 and is coaxial with the axial hole 13. The outer diameter of this tubular member 19 corresponds to the diameter of a mounting hole of an locking lever to be described hereinafter. An annular recessed portion 20 to contain a spring is formed around the tubular member 14**.

Figure 2:
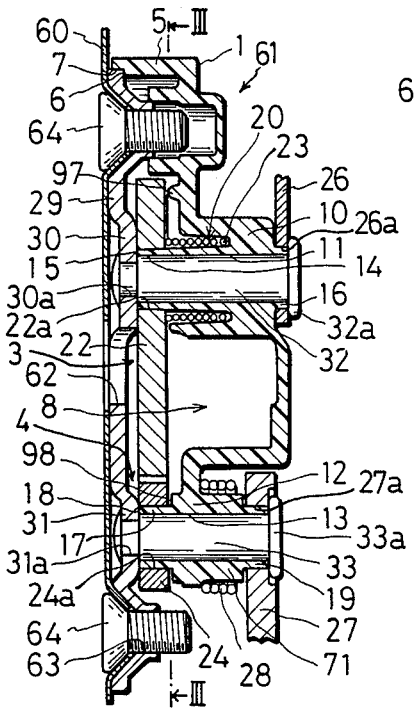
FIG. 2 is a section taken along a line II—II in FIG. 1, showing the relationship among a base plate, a latch body, pins, a latch element and a pawl.
Figure 3:
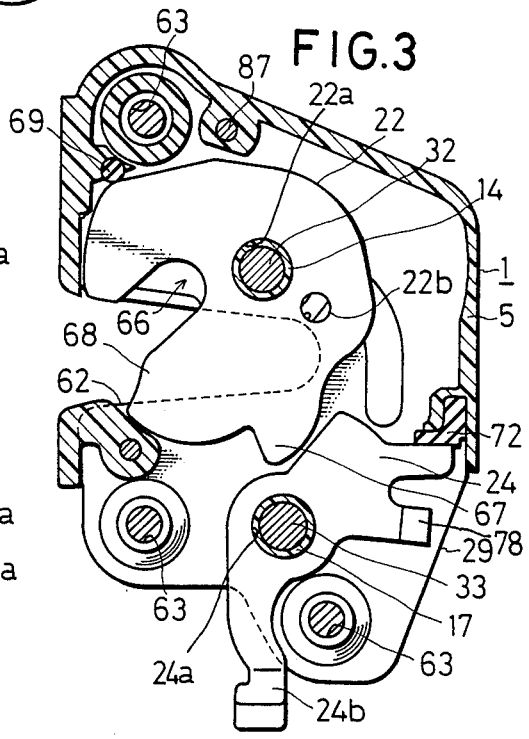
FIG. 3 is a section taken along a line III—III in FIG. 2.

The base plate 29 is prepared by pressing metallic sheets such as steel sheets and is formed with a striker inlet cut 62 and a plurality of mounting holes 63. As is best shown in FIG. 2, this plate 29 is secured on the door panel 60 by flat headed screws 64. The plate 29 is further formed with integral supporting rests 30, 31 at positions confronting the axial holes 11, 13 respectively and the rests 30, 31 are formed with holes **30*a*, 31*a*** respectively.

In the next place, one end of the pin 32 passed through the axial hole 11, the hole **30*a* and the tubular members 14, 16 is formed with a stepped portion and is caulked to the supporting rest 30 of the plate 29. The other end of the pin 32 is provided with a slip-off prevention head 32***a* with a diameter larger than that of the mounting hole 26*a* of the opening lever 26. The supporting rest 30 is pressed against the contact surface 15 by this pin 32. One end of the pin 33 passed through the axial hole 13, the hole 30*a* and the tubular members 17, 19 is formed with a stepped portion and is swaged to the supporting rest 31 of the plate 29. The other end of the pin 32 is provided with a slip-off prevention head 33*a* with a diameter larger than that of a mounting hole 27*a* of a locking lever 27. The supporting rest 31 is pressed against the contact surface 18 by this pin 33.

The latch element is made of metallic material and is formed integrally with a striker engage cut 66, a half lock pawl 67 and a full lock pawl 68. The latch element 22 is rotatably adapted, at the mounting hole 22*a* thereof, on the tubular member 14. The latch element 22 is biased by a latch returning spring 23 put in the annular recessed portion 20 in the clockwise direction (opening direction) of FIG. 3 and is obstructed from further turning by a rubber stopper stopper 69 attached to the body 1.

The pawl 24 is made also of metallic material and is rotatably adapted, at the mounting hole 24*a* thereof, on the tubular member 17. A numeral 25 represents a silencer rubber attached on the pawl 24. The pawl 24 is biased in the counterclockwise direction in FIG. 3 by a pawl returning spring 28 loaded on a spring mount 71 formed on the body 1 and is obstructed from further turning by a stopper rubber 72 attached to the body 1.

Now the various elements mounted on the body are explained. An opening lever 26 and a locking lever 27 are rotatably adapted, at mounting holes 26*a* and 27*a* thereof, on the tubular members 16 and 19 respectively. The opening lever 26 is biased in the counterclockwise direction of FIG. 1 by a spring 99. A control lever 75 and a opening rod 76 linked to an outer door handle are both connected to one end 26*b* of the opening lever 26 by a pin 74. The control lever 75 is provided with an integral pushing tongue 77 which confronts a linking projection 78 formed on the pawl 24. To one end of the locking lever 27 is connected an inside locking rod 79 linked to a lock knob on the inside of the automobile door. To the other end of the locking lever 27 is connected, by a clip 81, an outside locking rod (key rod) 80 linked to a key cylinder on the outside of the door. A headed connection stud 82 formed on the intermediate portion of the locking lever 27 is adapted in an elongated linking hole 83 formed in the control lever 75. Furthermore the locking lever 27 is biased by a locking spring 84 so that the lever 27 may be brought alternatively to a locked position and an unlocked position.

A metallic back plate 86 is secured on the body 1 by pins 87. An inside lever 88 is pivotally connected to this back plate 86 by a pin 89. One end 88*a* of the lever 88 is in opposing relation with the other end 26*c* of the opening lever 26. To the other end 88*b* of the lever 88 is connected, by a rod clip 91, an inside opening rod 90 linked to a handle on the inside of the automobile door.

The above mentioned automobile door locking apparatus is operated in a well known manner. Namely, when the automobile door is shut the striker advances towards the latch 61 through the striker inlet cut 62 formed in the plate 29 and the groove 8 formed in the body 1 and strikes the latch element 22. Then the latch element 22 is turned and the striker 9 is caught in the striker engage cut 66. At the same time, the pawl 24 engages the half lock pawl 67 or the full lock pawl 68 and the latch element 22 is prevented from returning to the original position. Thus the automobile door is kept closed.

On the other hand, the automobile door is opened the operation of the automobile door locking apparatus is as follows. When the locking lever 27 is in the unlocking position the opening lever 26 is turned in the clockwise direction in FIG. 1 by pushing the opening rod 76. The opening lever 26 is turned in the same direction also by the inside lever 88 when the inside opening rod 90 is pulled. Then the control lever 75 is shifted to the downwards direction in FIG. 1 and the pushing tongue 77 thereof pushes the linking projection 78 of the pawl 24. Consequently the pawl 24 is pulled apart from the latch element 22, which is returned by the biasing force of the spring 23 and releases the striker 9. The door can be opened. When the inside lock rod 79 or the outside lock rod 80 has been operated to shift the locking lever 27 to the locking position the the pushing tongue 77 of the control lever 75 turns aside from the linking projection 78 of the pawl 24. Accordingly even if the opening rod 76 or 90 is operated to turn the opening lever 26 the displacement of the lever 26 is not transmitted to the pawl 24 and the latch element 22 is not released.

Figure 6:
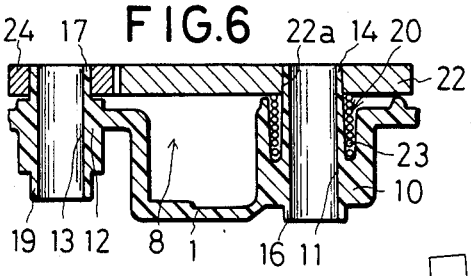
FIG. 6 is a section showing the latch element and the pawl assembled on the latch body.
Figure 5:
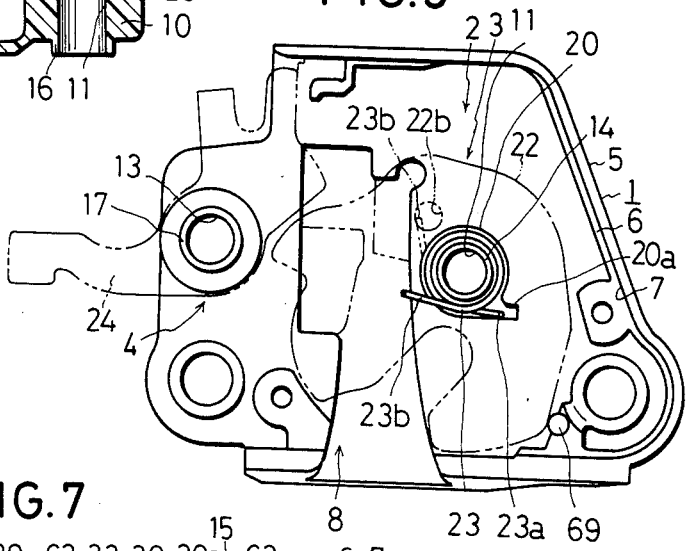
FIG. 5 is a plane view for explaining the procedure to assemble the latch element and the pawl on the latch body.
Figure 7:
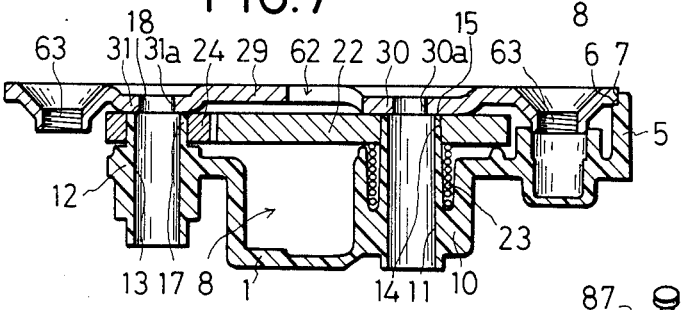
FIG. 7 is s section showing the structure of FIG. 6, further coupled with the base plate.
Figure 8:
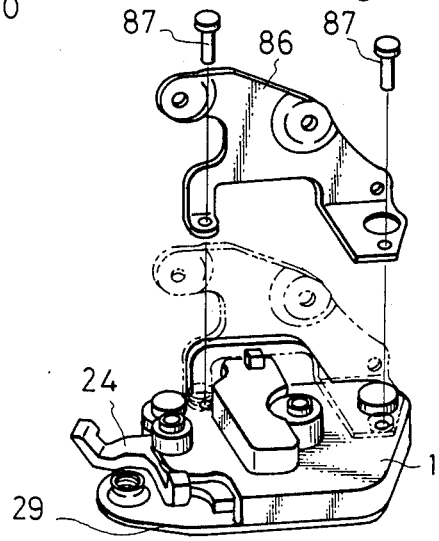
FIG. 8 is a perspective view for explaining the procedure to put a back plate on the latch body.
Figure 9:
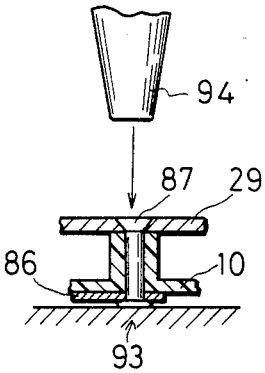
FIG. 9 is a section for explaining the work to secure the back plate against the latch body.
Figure 10:
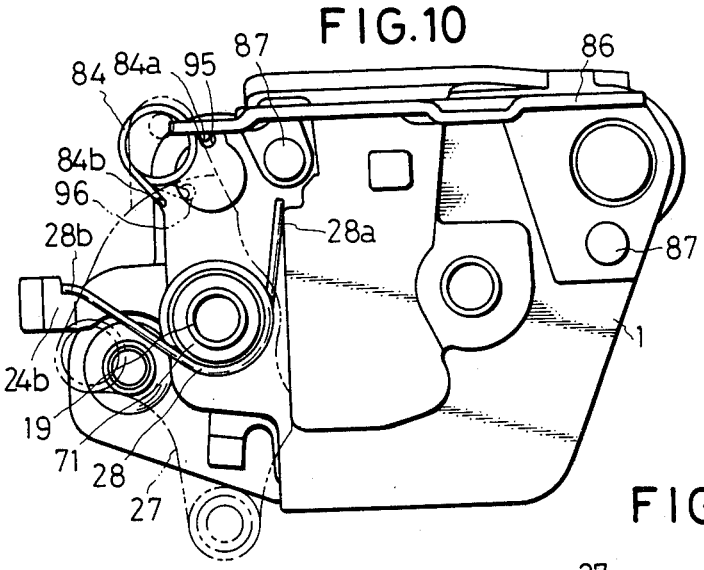
FIG. 10 is a plane view for explaining the procedure to attach a locking lever to the latch body.
Figure 11:
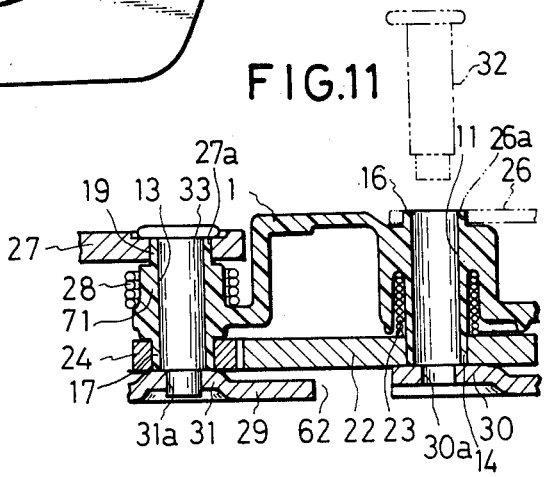
FIG. 11 is a section for explaining the procedure to attach an opening lever to the latch body.
Figure 12:
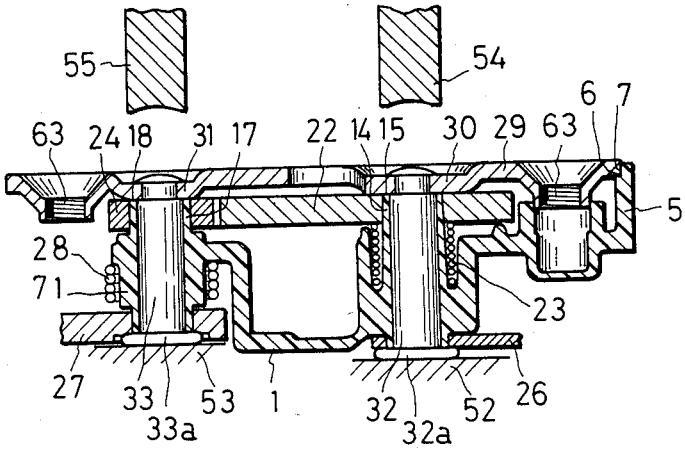
FIG. 12 is a section for explaining the procedure to caulk the pins to the base plate.

Now the assembling of the above mentioned automobile door latch 61 is explained. First, as shown in FIG. 5, the latch returning spring 23 is loaded in the annular recessed portion 20 with one end 23*a* thereof put in a groove 20*a* formed on the body 1. Then other end 23*b* of the spring 23 is hooked in a hole 22*b* formed in the latch element 22 and the spring 23 is slightly tightened. The latch element 22 is simultaneously mounted on the tubular member 12 as shown in FIG. 5 by alternate long and two short lines. Under this situation the latch element 22 is subject to the biasing force of the spring 23. However, the latch element 22 can remain at a prescribed position where the mounting hole 22*a* of the latch element 22 can be coaxial with the axial hole 11 in the body 1 since the mounting hole 22*a* of the latch element 22 is passed through by the tubular member 14. Next the pawl 24 is adapted on the tubular member 17 as shown in FIG. 6. Further the base plate 29 is put on the abutting surface 6 of the body 1 and is caused to confront the body 1 with the supporting rests 30 and 31 abutting the contact surfaces 15 and 18 respectively as shown in FIG. 7. In this case the plate 29 and the body 1 are mutually positioned by the positioning surface 7 formed on the periphery of the body 1. Then the back plate 86 is attached to the opposite side of the body 1 by pins 87, 87 as shown in FIG. 8. In this case one end of the pin 87 is put on a jig 93 and the other end of the pin 87 is swaged with a swaging tool 94 as shown in FIG. 9. By this swaging work not only the back plate 86 is fixed but also the plate 29 is simultaneously united with the body 1. Moreover the metallic base plate 29 and back plate 86 are fixed by swaged pins 87 on the both sides of the body 1 which is made of plastics rather inferior in mechanical strength. Thus such an accident does not occur that the body 1 is unintentionally cracked or broken in the swaging work. The pawl returning spring 28 is set on the spring mount 71 with one end 28*a* thereof hooked on a stepped spring holder of the body 1 and with the other end 28*b* hooked on a spring holder 24*b* formed on the paul 24 as shown in FIG. 10. One end 84*a* of the locking spring 84 is fixed in a spring holding hole 95 formed in the body 1. Next the other end of the locking spring 84 is fixed in a spring holding hole 96 formed in the locking lever 27 and the locking lever 27 is mounted on the tubular member 19 at the mount hole 27*a* thereof while the spring 84 is tightened. Under this sutuation the locking lever 27 is subject to the biasing force of the spring 28. However, the locking lever 27 can remain at a prescribed position where the mounting hole 27*a* of the locking lever 27 can be coaxial with the axial hole 13 in the body 1 since the mounting hole 27*a* is passed through by the tubular member 19. Next the pin 33 is inserted in the axial hole 13 as shown in FIG. 11. In this case the locking lever 27 is maintained at the prescribed position, the pawl 24 is positioned as well by the tubular member 17 and the plate 29 is positioned against the body 1. Therefore the pin 33 can be passed through all these members from the side of the tubular member 19 to the hole 31*a* in the plate 29. On the other hand, in a procedure other than one just mentioned, the control lever 75, the opening lever 26 and the opening rod 76 are beforehand connected by the pin 74. Then the the opening lever 26 is adapted on the tubular member 16 at the mounting hole 26*a* thereof and the pin 32 is inserted in the axial hole 11 as shown in FIG. 11. In this case the latch element 22 is maintained at the prescribed position by the tubular member 14 as aforementioned and the plate 29 is positioned against the body 1. Accordingly the pin 32 can easily be passed through all these members from the side of the tubular member 16 to the hole 30*a*. After the pins 32 and 33 have been inserted in the axial holes 11 and 13 respectively, the head portions of the pin 32, 33 are placed on jigs 52, 53 and are swaged to be fixedly connected to the plate 29 with swaging tools 54, 55 as shown in FIG. 12. Under the situation where the pins 32, 33 have been swaged, the supporting rests 30 and 31 are urged against the contact surfaces 15 and 18 respectively and the axial backlash between the body 1 and the pin 32 and 33 is completely eliminated. The lever 88 is pivotally connected to the back plate 86 with the pin 89, to which the opening rod 90 is connected. The locking rods 79 and 80 are both connected to the locking lever 27. The overall structure of the automobile door latch 61 is thus completed. The completed door latch 61 together with the striker 9 is forwarded to an assembling factory of automobiles.

When the automobile door latch 61 is assembled in the above mentioned manner the latch element 22 is the pawl 24 can be correctly positioned between the body 1 and the plate 29 by the tubular members 14 and 17 respectively without pins 32, 33. Accordingly it is possible to group such works, as a first subassembling procedure, as to assemble the base plate 29 and the back plate 86 to the body 1 coupled with the latch element 22 and the pawl 24 and to secure these plates with pins 87 on the body. In the second subassembling procedure other than the first one are included such works as to mount the other members, for example, the locking lever 27 and the opening lever 26. Namely the overall assembling procedure can be divided into subassembling procedures. This is very effective to systematize the assembling work of the door latch.

Furthermore, in the automobile door latch 22 assembled in the above mentioned manner, the distance between the body 1 and the plate 29 is maintained, by the tubular member 14, at a value larger than the thickness of the latch element 22. Thus the latch element 22 can be prevented from being urged by the plate 29 and can be smoothly turned. The distance between the body 1 and the pawl 24 is as well maintained, by the tubular member 17, at a value larger than the thickness of the pawl 24. Thus the pawl 24 can be smoothly turned in the similar manner. Moreover the metallic latch element 22 and pawl 24 are adapted on the tubular members 14 and 17 both made of plastic materials respectively at the mounting holes 22*a* and 24*a* thereof. Thus the latch element 22 and the pawl 24 are obstructed from contacting directly the pins 32 and 33 respectively when the latch element 22 and the pawl are turned. Therefore the occurrence of the such metallic sounds that are due to the direct contact is prevented. When a large force is exerted on the latch element 22 or the pawl 24 in the direction perpendicular to the axis of the tubular member 14 or 17 the force is transmitted through the tubular member 14 or 17 to the pin 32 or 33 which can tolerate the force. In this manner the damage of the tubular members 14 and 17 is avoided. The advantages which have been said about the latch element 22 and the pawl 24 in this paragraph can be substantially said about the opening lever 26 and the locking lever 27 as well.

Figure 4:
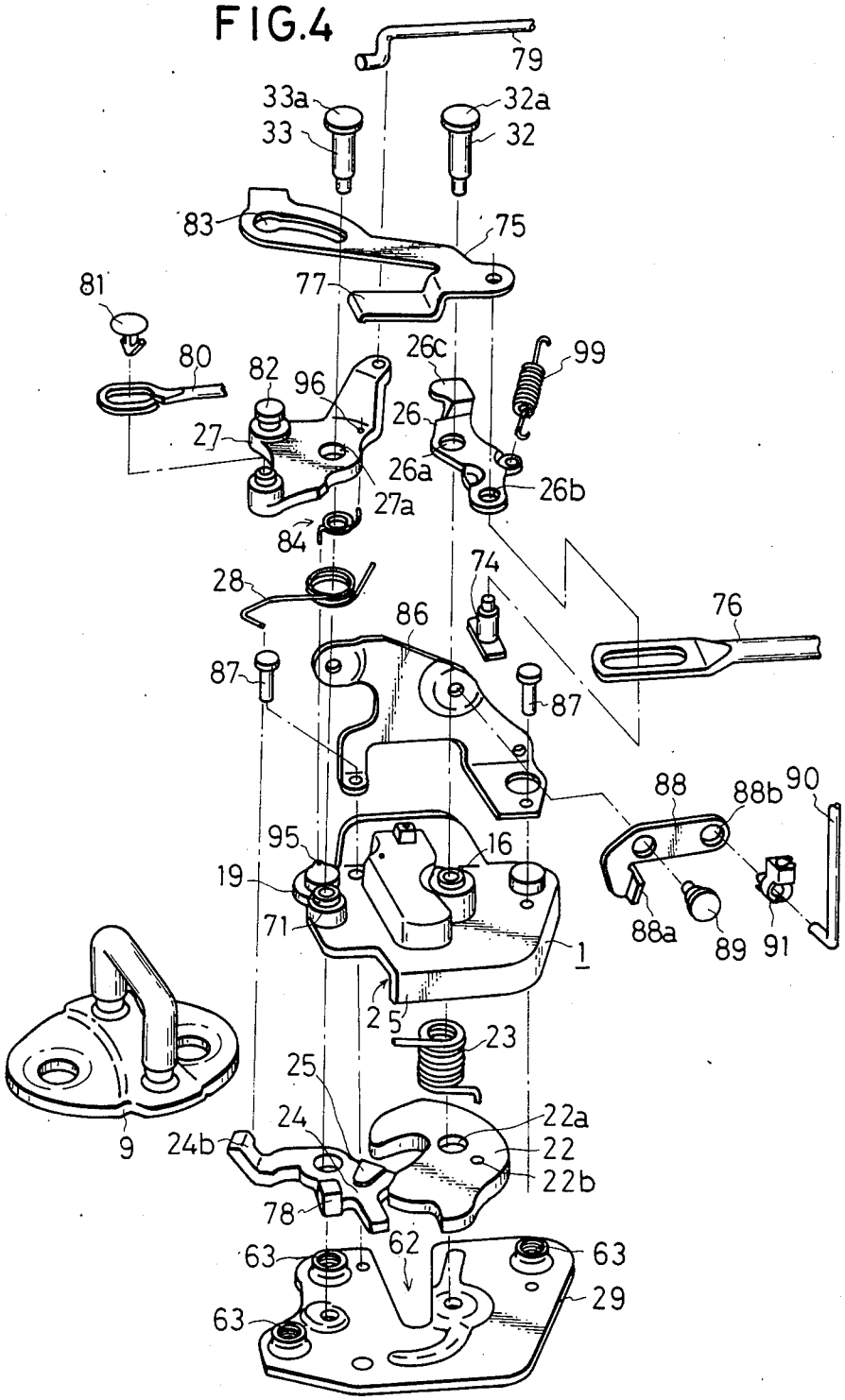
FIG. 4 is a perspective view showing the dismantled automobile door latch of FIG. 1.
Figure 13:
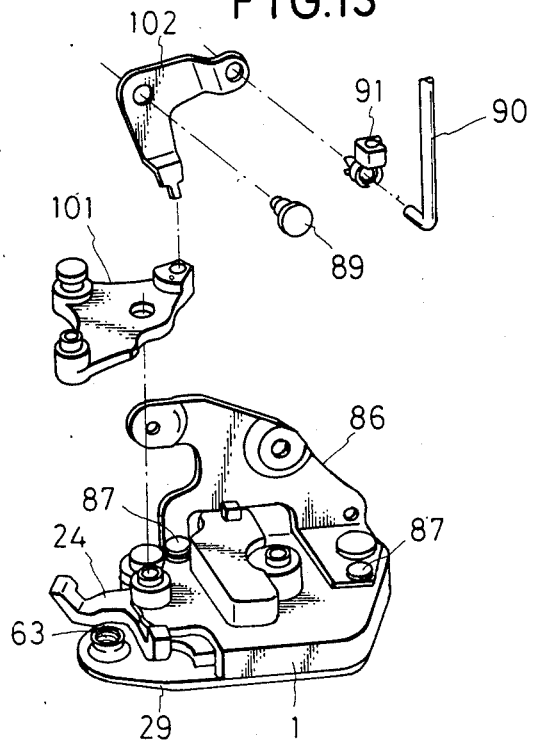
FIG. 13 is a perspective view of a partially dismantled automobile door latch provided with a differently shaped locking lever and an differently shaped inside lever.

Next, FIG. 13 shows a different automobile door latch which includes a locking lever 101 and an inside lever 102 different from those shown in FIG. 4 and the other component parts similar to those shown in FIG. 4. When the division of the assembling procedure is possible the subassemblies prepared by the first subassembling procedure can be mass produced in advance. If the component parts 101 and 103 of FIG. 13 are used in the second subassembling procedure the different automobile door latch can be assembled.

Figure 15:
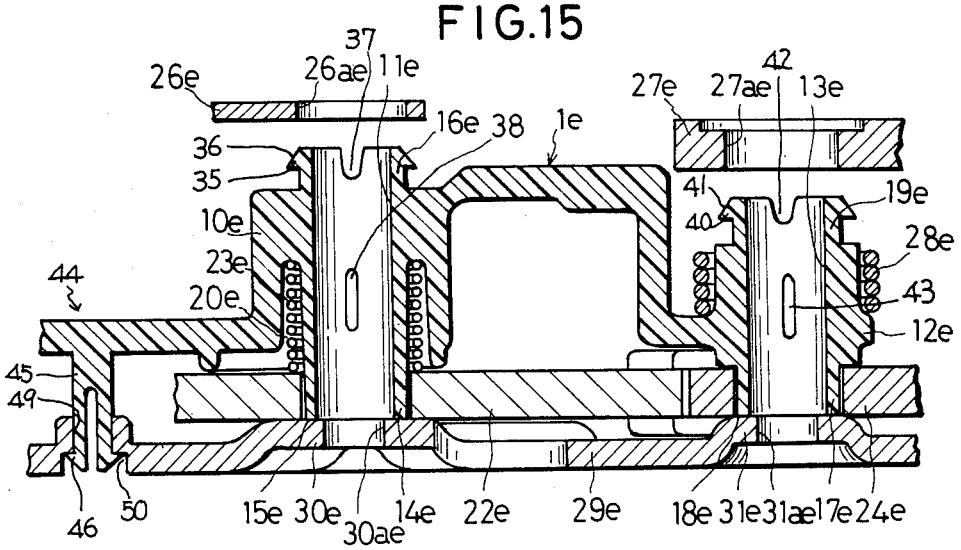
Figure 16:
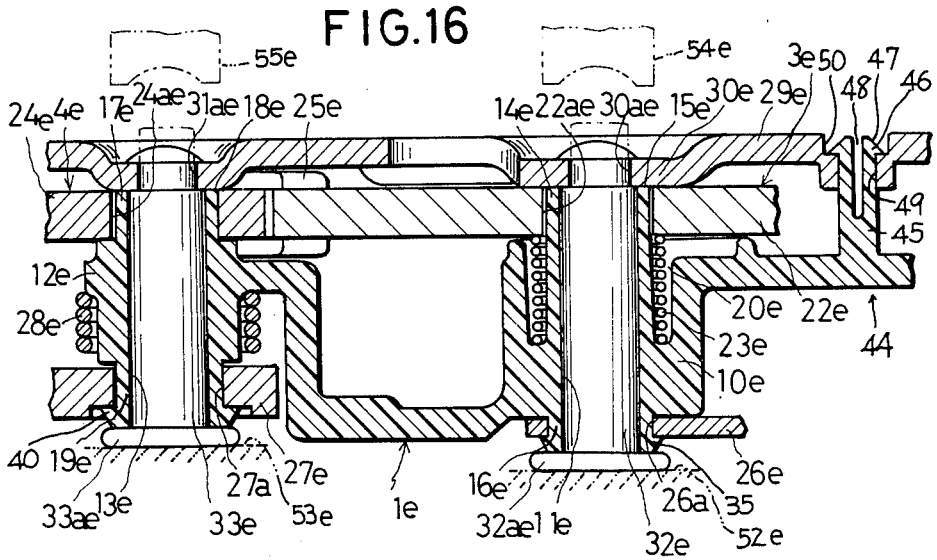
Figure 17:
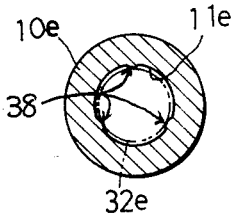

Another embodiment of the present invention is now explained in reference to FIGS. 14 through 17. These figures show an embodiment in which a latch body 1*e* is provided with various temporary fastening members. In the figures a numeral 35 represents an umbrella-type slip-off prevention element which is formed integrally with the peripheral end portion of a tubular member 16*e* formed on a pin insertion mount 10*e*. The diameter of the element 35 is made larger than that of a mounting hole 26*ae* formed in the opening lever 26*e*. The free end portion of the tubular member 16*e* is formed with a partial conical surface 36 as shown. The tubular member 16*e* is formed, at the free end portion thereof, with cuts 37 for easy deformation thereof in the inwards radial direction. The cuts 37 are formed at two or more angularly equally spaced positions. An axial hole 11*e* is formed, on the internal surface thereof, with projecting pieces 38. The height of the projecting piece 38 is adjusted to such a value that the piece 38 can exert an appropriate pressing force on the side surface of a pin 32*e* inserted in the axial hole 11*e*. The number of the pieces 38 may be one or more than two. In the present embodiment, however, three pieces 38 are formed as shown in FIG. 17 in order to make the axis of the axial hole 11*e* coincide exactly with the axis of the pin 32*e* inserted in the hole 11*e*. A slip-off prevention element 40, a partial conical surface 41, a cut 42 and a projecting pieces 43 are similar and corresponding to the component parts represented by numerals 35 through 38. A numeral 44 represents a temporary fastening element for the body 1*e* and the base plate 29*e*. In the element 44 a slip-off prevention stud 45 is projecting from the body 1*e* and formed integrally with the body 1*e*. A slip-off prevention part 46 is formed on the outer periphery of the free end of the stud 45. The free end portion of the stud 45 is formed with a partial conical surface as shown. A slot 48 is formed in the stud 45 to a depth reaching the intermediate portion from the extreme end of the stud 45. This slot 48 is provided in order to make easy the inwards radial deformation of the stud 45. The cross section of the slot 48 viewed from the end of the stud 45 is made in the form of a thin rectangle or a cross. A mounting hole 49 is bored in the plate 29*a* and the diameter of the hole 49 is made smaller than the outer diameter of the slip-off prevention part 46. A recessed portion 50 is provided in order to position the slip-off part 46 without extending beyond the upper surface of the plate 29*e*. The temporary fastening element 44 may be provided, for example, at two positions so that the body 1*e* and the plate 29*e* may be fastened temporarily but stably. However, when the automobile door latch include a structure where the peripheral edge of the plate 29*e* is supported by the abutting surface as in the preceding embodiment only one element 44 will suffice.

Figure 14:
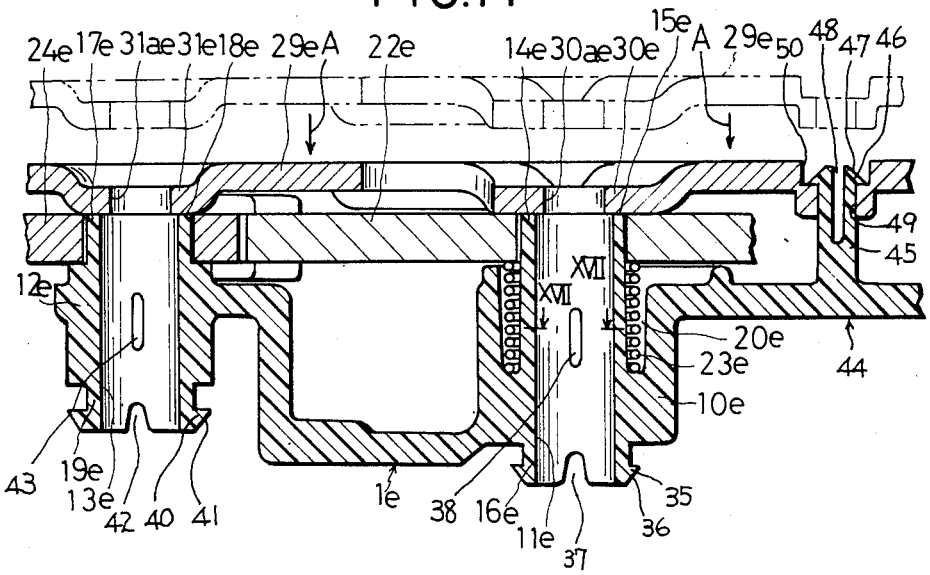
FIGS. 14 through 17 are views of different embodiments, FIG. 14 being a section showing the latch returning spring, the latch element and the pawl all attached already to the body and the further coupled base plate.

The above mentioned door latch is assembled as follows. First the latch element 22*e* and the pawl 24*e* are mounted on the latch body 1*e* according to the direction of arrangement as shown in FIG. 14. Then the plate 29*e* is united with the body 1*e* in the direction shown by an arrow A and the end portion of the stud 45 is adapted in the hole 49. The adapting work is easy on account of the partial conical surface 47 and the slot 48. Next the arrangement of FIG. 14 is turned upside down as shown in FIG. 15. The opening lever 26*e* and the locking lever 27*e* are adapted on the tubular members 16*e* and 19*e* respectively. In this case the body 1*e* and the plate 29*e* are united by the element 44 not to be separated from each other. Accordingly, the subassembled structure can be skillfully treated. Next the structure is returned to the original uninverted situation as shown in FIG. 16 and the pins 32*e* and 33*e* are inserted in the axial holes 11*e* and 13*e* respectively. The pins 32*e* and 33*e* with bottom surfaces thereof resting on jigs 52*e* and 53*e* are swaged, at the top ends thereof, to the plate 29*e* by means of swaging tools 54*e* and 55*e*. Also in this case the body 1*e* and the plate 29*e* are united. The mounts of the opening lever 26*e* and the locking lever 27*e* on the tubular members 16*e* and 19*e* are maintained by the slip-off prevention elements 35, 40. Moreover the pins 32*e* and 33*e* inserted in the axial holes 11*e* and 13*e* are obstructed from slipping-off by the projecting pieces 38, 43 pressing tightly thereon. Thus the work to put the lower end portions of the pins 32*e*, 33*e* on the jigs 52*e*, 53*e* and the work to swage the pins 32*e*, 33*e* to the plate 29*e* with the caulking tools 54*e*, 55*e* are easy. Accordingly it is very easy to automate the above described assembling procedure. Furthermore a succession of works till the insertion of the pins 32*e* and 33*e* into the axial holes 11*e* and 13*e* require no special tools and are suitable for home works.

In the automobile door latch assembled in the above described manner the pins 32*e*, 33*e*. The opening lever 26*e* and the locking lever 27*e* are all metallic but plastic tubular members 16*e* and 19*e* are interposed between the pin 32*e* and the lever 26*e*, and the pin 33*e* and the lever 27*e*. Consequently the metallic component parts can operate quietly and any metallic sound is not uttered. The opening lever 26*e*, the locking lever 27*e*, and pins 32*e*, 33*e* will be exposed to the rain at times and may be rusted. The levers 26*e* and 27*e* seized by rust may not move at all. This defect in operation can be prevented from occurring by the usage of the interposed plastic tubular members. Those component parts in the second embodiment of the automobile door latch which are considered to be the same as or structurally equivalent to those of the first embodiment are given the numerals the same as before but with an alphabet e. These parts are not repeatedly explained. The component parts in the following figures are given the same numeral with an alphabet f according to the same idea and are not repeatedly explained.

Figures 18A, 18B:
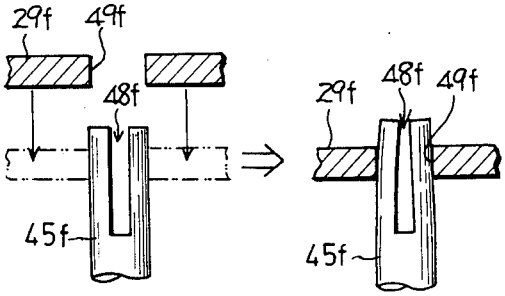
FIGS. 18 (A) and 18 (B) are views showing different examples of a slip-off prevention stud.

Lastly FIGS. 18 (A) and 18 (B) show another embodiment of the slip-off prevention element. The diameter of a stud 45*f* is made slightly larger then the diameter of a hole 49*f* and the oversized stud 45*f* is forced into the hole 49*f*. The plate 29*f* is temporarily united with the body 1*f* by the friction between the outer surface of the stud 45*f* and the internal surface of the hole 49*f*.

As many apparently widely different embodiments of this invention may be made without departing from the spirit and scope thereof, it is to be understood that the invention is not limited to the specific embodiments thereof except as defined in the appended claims.

What is claimed is:

1. A automobile door latch comprising:

a base plate having a mounting portion which fastens on a door panel of an automobile, said base plate including spaced apart first and second holes for receiving a latch retaining pin and a pawl retaining pin;

a recessed latch body facing said base plate, including a latch space adjacent said base plate for retaining a latch and a pawl space facing said base plate retaining a pawl, said latch body providing a plastic tubular support opposite said base plate first hole coaxial with said first hole and a corresponding hole in said latch, and said latch body including a hole aligned with said base plate second hole and a corresponding hole in said pawl.

a latch returning spring wound about said tubular member having one end connected to said latch and the other to said latch body;

an opening lever having a hole large enough to be received over the distal end of said tubular member;

a first pin element having head larger than said lever hole, extending through said lever, tubular member and latch, said pin having a front end portion stepped to be received in said first hole, and extending through said first hole and then swaged, forming a perpendicular relationship with said base plate retaining said base plate, latch body and lever in position; and a second pin element extending through said latch body hole, pawl, and base plate second hole retaining said base plate, pawl and latch body in a fixed relationship.

2. An automobile door latch as set forth in claim 1 further comprising; another plastic tubular member for insertion of said pin for said pawl, said another tubular member being integral with said body and coaxial with said hole in said body for insertion of said pin for said pawl at one end there of, having a length suitable to put the other end thereof in said mounting hole in said pawl to be placed along said base plate, having an inner diameter suitable to insert therethrough said pin for said pawl and having an outer diameter suitable to mount thereon said pawl at its mounting hole.

3. An automobile door latch as set forth in claim 2, wherein said body is provided with positioning elements for restricting the axial positions of said latch element and said pawl relative to said body, each extreme end of said tubular members is formed with a contact surface to receive said base plate in a situation that said base plate and said body are united with each other and the distance between said each contact surface and said each positioning element is slightly larger than the thickness of said latch element or said pawl.

4. An automobile door latch as set forth in claim 3, further comprising:

a locking lever formed with a hole for insertion of said pin for said pawl, a locking spring with one end thereof connected to said body and the other end thereof connected to said locking lever, and said another integral tubular member which is formed on the outer side of said body, is coaxial with said second hole and has an outer diameter suitable to be received in said locking lever and an inner diameter for insertion of said pin for said pawl.

5. An automobile door latch as set forth in claim 2, wherein each of the inner surfaces of said tubular members for said latch element and said pawl is provided with at least one projecting piece which contacts said pin inserted therethrough as tightly as possible so long as said pin can be inserted in said tubular member.

6. An automobile door latch as set forth in claim 4, wherein said each extreme end portion of said tubular members for said opening lever and said locking lever is formed with an umbrella-type slip-off prevention element extending radially of said tubular member having longitudinal cuts for permitting inward contraction thereof.

7. An automobile door latch as set forth in claim 1, wherein said latch body is formed with an integral slip-off prevention stud and said base plate is formed with a hole for insertion of said slip-off prevention stud, the extreme end portion of said stud having at an end thereof an umbrella-type portion extending radially beyond said stud and with axial slots for easy inwards contraction of said stud.

8. The automobile door latch of claim 1, wherein said opening lever is mounted for rotation about said tubular member.

* * * * *